US005783785A

United States Patent [19]

Furukawa

[11] Patent Number: 5,783,785

[45] Date of Patent: Jul. 21, 1998

[54] SWITCH INCLUDING TWO STEP SEQUENTIAL OPERATION

[75] Inventor: Osamu Furukawa, Tokyo, Japan

[73] Assignee: Niles Parts Co., Ltd., Japan

[21] Appl. No.: 810,110

[22] Filed: Feb. 25, 1997

[30] Foreign Application Priority Data

Mar. 1, 1996 [JP] Japan ..... 8-071367

[51] Int. Cl.[6] ..... H01H 15/04

[52] U.S. Cl. ..... 200/1 B; 200/16 C; 200/16 D

[58] Field of Search ..... 200/1 R, 1 V, 200/1 B, 5 R, 6 R, 6 B, 6 BB, 16 R, 16 C, 16 D, 303

[56] References Cited

U.S. PATENT DOCUMENTS

| | | | |
|---|---|---|---|
| 4,866,221 | 9/1989 | Obermann et al. | 200/5 R |
| 5,258,593 | 11/1993 | Hayakawa | 200/1 B |
| 5,378,863 | 1/1995 | Sekita | 200/16 R |
| 5,414,231 | 5/1995 | Sato et al. | 200/1 R |
| 5,647,478 | 7/1997 | Hirai | 200/303 |

FOREIGN PATENT DOCUMENTS 7-158339 6/1995 Japan .

*Primary Examiner*—J. R. Scott
*Attorney, Agent, or Firm*—Rader, Fishman & Grauer

[57] ABSTRACT

A two-step operation switch device, in which intervals between a common fixed contact and other fixed contacts juxtaposed to the common fixed contact are kept as wide as possible so that insulating properties between the contacts are maintained in a normal state. The common fixed contact 11, first fixed contacts 12, 13, and second fixed contacts 14, 15 are disposed on an insulating plate 1. A movable contacting piece 2 has a first contacting piece 21 slid in a first region, in which the common fixed contact 11 and the first fixed contacts 12 and 13 are juxtaposed, and a second contacting piece 22 slid in a second region, in which the common fixed contact 11 and the second fixed contacts 14 and 15 are juxtaposed. Intervals W2 between the common fixed contact 11 and the second fixed contacts 14 and 15 in the second region Z2 are wider than intervals between the common fixed contact 11 and the first fixed contacts 12 and 13 in the first region Z1. A width W4 of the common fixed contact 11 on the second region Z2 side is greater than a width W3 thereof on the first region Z1 side so that the movable contacting piece 2 is connected with the first fixed contacts 12 and 13 in the first region Z1 and the common fixed contact 11 in the second region Z2, when the movable contacting piece 2 is at first positions MU and MD.

7 Claims, 3 Drawing Sheets

SWITCH INCLUDING TWO STEP SEQUENTIAL OPERATION

BACKGROUND OF THE INVENTION

1. Field of the Invention

The present invention relates to a two-step operation switch device and, in particular, to an improvement of a two-step operation switch device suitable for a power window unit or the like, which has manual operation positions and automatic operation positions.

2. Description of the Related Art

A conventional two-step operation switch device is disclosed, for example, in Japanese Patent Publication No. A-Hei 7-158339. The conventional two-step operation switch device has been used for power window units and the like, in which manual operation positions and automatic operation positions were required. The conventional switch device includes a common fixed contact, first fixed contacts with which a movable contacting piece is brought into contact in the manual operation positions, and second fixed contacts with which the movable contacting piece is brought into contact in the automatic operation positions. The switch device is constructed so that the movable contacting piece is normally contacted with the common fixed contact.

However, the conventional two-step operation switch device has problems resulting from a slide switch structure used to contact normally the movable contact with the common fixed contact. Specifically, the intervals between the common fixed contact and the first or second fixed contacts are very small, thereby making it difficult to keep an insulating property between the common fixed contact and the other fixed contacts in a normal state.

SUMMARY OF THE INVENTION

It is an object of the present invention to provide an improved two-step operation switch device that overcomes the problems associated with the conventional operation switch device described above.

More specifically, it is an object of the present invention to provide a two-step operation switch device, in which the intervals between the common fixed contact and the other fixed contacts are enlarged as far as possible to maintain an insulating property between the common fixed contact and the other fixed contacts in a normal state.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a two-step operation switch device is provided comprising: an insulating plate; a movable contacting piece movable between a neutral position, first positions, and second positions set on the insulating plate; and a common fixed contact, two first fixed contacts and two second fixed contacts disposed on the insulating plate. The two-step operation switch device is characterized by: the movable contacting piece including a first contacting piece sliding in a first region, in which the fixed contact and the first fixed contacts are juxtaposed, and a second contacting piece sliding in a second region, in which the common fixed contact and the second fixed contacts are juxtaposed; an interval between the common fixed contact and the second fixed contacts in the second region being set so as to be greater than an interval between the common fixed contact and the first fixed contacts in the first region; and at least one of the common fixed contact and the movable contacting piece being so shaped that the movable contacting piece is connected both with one of the first fixed contacts in the first region and with the common fixed contact in the second region, when the movable contacting piece is at the first position.

A width of the common fixed contact on the second region side is preferably set so as to be greater than a width thereof on the first region side.

The neutral position corresponds to a neutral position of a power window, the first positions correspond to manual operation positions of the power window, and the second positions correspond to automatic operation positions of the power window.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

A preferred embodiment of a two-step operation switch device according to the present invention will now be described, by way of example, with reference to FIGS. 1 to 4 of the accompanying drawings.

Figure 4:
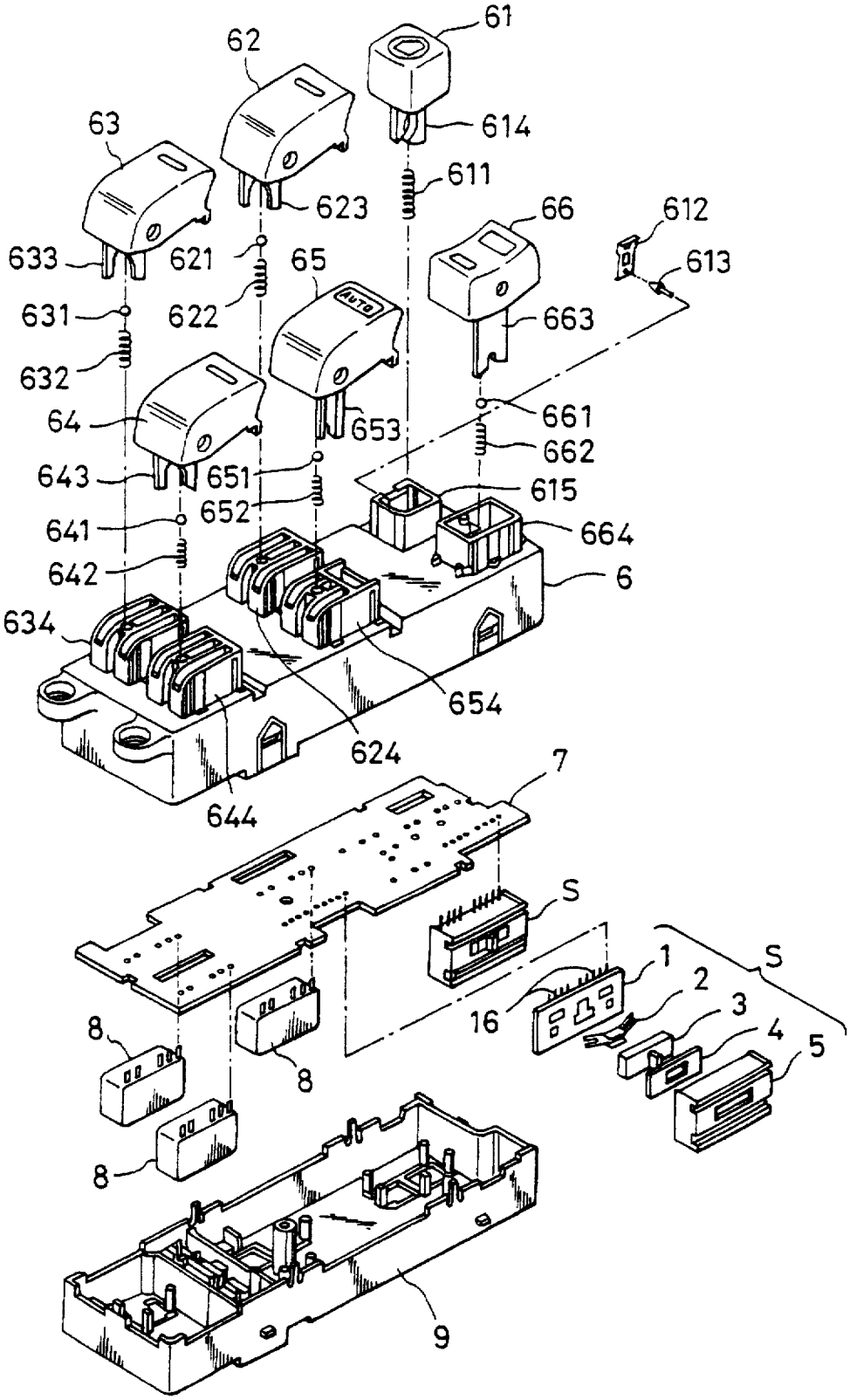
FIG. 4 is an exploded perspective view of a power window unit incorporating the two-step operation switch device shown in FIG. 1.

FIG. 4 shows a power window unit incorporating a pair of two-step operation switch devices S. Apart from the two-step operation switch devices S, the power window unit includes a cover 6, a base plate 7, module switches 8, and a bottom cover 9. Further, on the upper cover 6 there are mounted knobs 61, 62, 63, 64, 65, 66; coil springs 611, 622, 632, 642, 652, 662; steel balls 621, 631, 641, 651, 661; a plate spring 612; and a pin 613. Each of the knobs 61, 62, 63, 64, 65, 66 has an operation lever 614, 623, 633, 643, 653, 663. The operation levers 614, 623, 633, 643, 653, 663 are engaged with the two-step operation switch devices S or the module switches 8 through frame bodies 615, 624, 634, 644, 654, 664 mounted on the upper cover 6.

Figure 1:
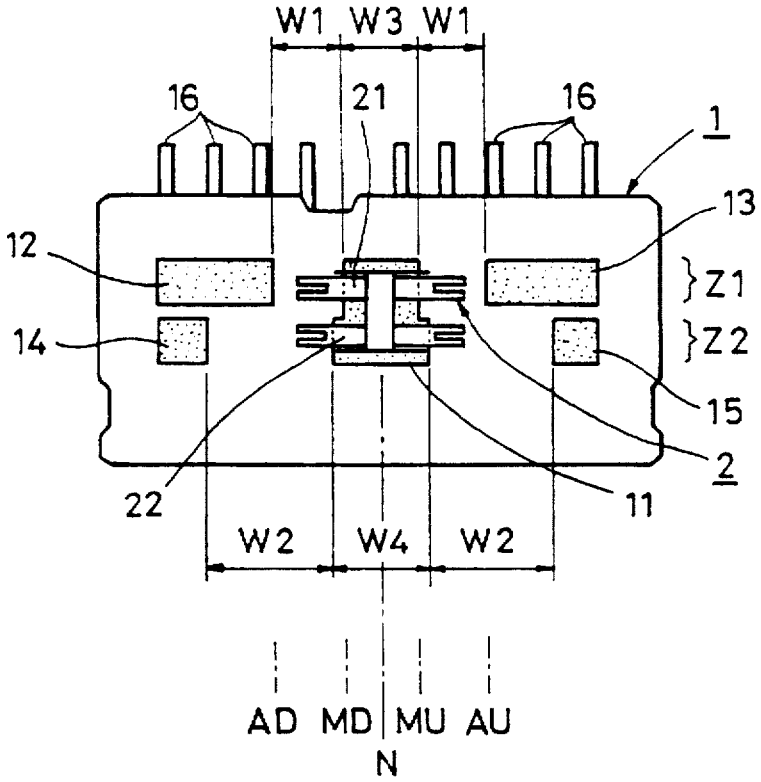
FIG. 1 is a plan view of a two-step operation switch device according to a preferred embodiment of the present invention, in which a movable contacting piece is at the neutral position N.
Figure 2:
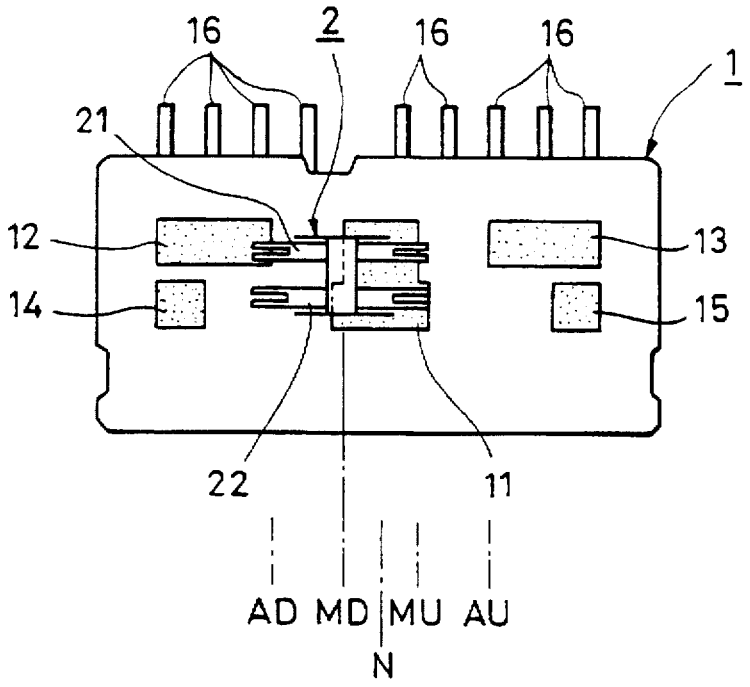
FIG. 2 is a plan view of the two-step operation switch device shown in FIG. 1, in which the movable contacting piece is at the first position MD.
Figure 3:
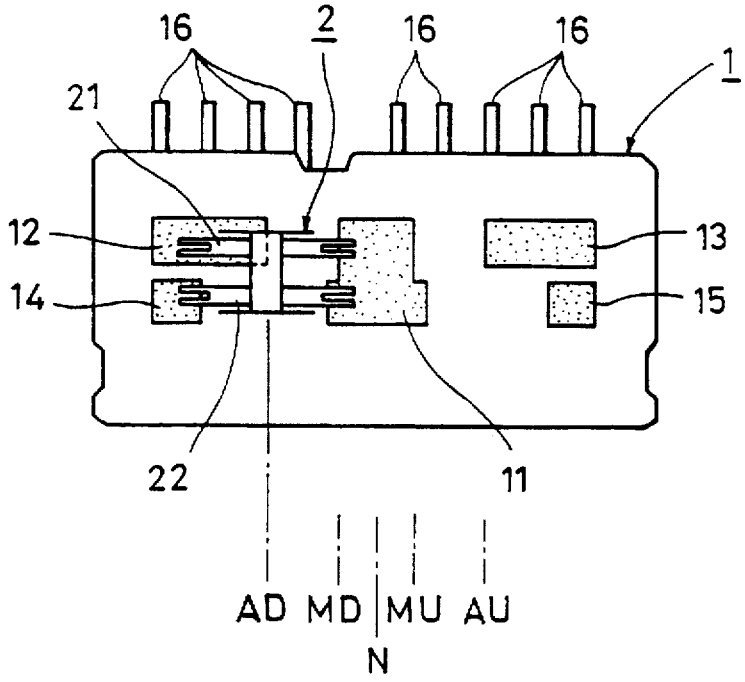
FIG. 3 is a plan view of the two-step operation switch device shown in FIG. 1, in which the movable contacting piece is at the second position AD.

The two-step operation switch device S is composed of an insulating plate 1, a movable contacting piece 2, an operation lever 3, a cover 4, and a case 5. The switch device S is soldered to the base plate 7 through lead terminals 16. FIGS. 1 to 3 are plan views of the two-step operation switch device S, in which the operation lever 3, the cover 4, and the case 5 are omitted. As shown in FIGS. 1 to 3, on the upper surface of the insulating plate 1 there are disposed a common fixed contact 11, two first fixed contacts 12, 13, and two second fixed contacts 14, 15.

On the insulating plate 1 there are set a neutral position N, first positions MU, MD, and second positions AU, AD, corresponding to operation positions of the knob 65, as well as a first region Z1 and a second region Z2 corresponding to movement paths of the movable contacting piece 2. The neutral position N is a position of the movable contacting piece 2 when the knob 65 is at the neutral position; the first positions MU, MD are positions of the movable contacting piece 2 when the knob 65 is at the manual operation position; and the second positions AU, AD are positions of the movable contacting piece 2 when the knob 65 is at the automatic operation position. On the other hand, the first region Z1 is a region where the common fixed contact 11 and the first fixed contacts 12, 13 are juxtaposed, and the second region Z2 is a region where the common fixed contact 11 and the second fixed contacts 14, 15 are juxtaposed.

The movable contacting piece can be arbitrarily moved between the neutral position N, the first positions MU, MD, and the second positions AU, AD set on the insulating plate 1. The movable contacting piece has a first contacting piece 21 sliding in the first region Z1 and a second contacting piece 22 sliding in the second region Z2 on the insulating plate 1.

Between the common fixed contact 11 and each of the first fixed contacts 12, 13 set on the insulating plate 1 there is an interval W1, while between the common fixed contact 11 and each of the second fixed contacts 14, 15 there is an interval W2, which is wider than the interval W1. In addition, the common fixed contact 11 has a width W4 on the second region Z2 side which is greater than a width W3 of the common fixed contact 11 on the first region Z1 side. In this way, when the movable contacting piece 2 is moved from the neutral position N to one of the first positions MU and MD, the first contacting piece 21 on the first region Z1 side is brought into contact with one of the first fixed contacts 12 and 13 and, at the same time, the second contacting piece 22 on the second region Z2 side is brought into contact with the common fixed contact 11.

On the other hand, when the movable contacting piece 2 is moved from the neutral position N to one of the second positions AU and AD, the second contacting piece 22 on the second region Z2 side is brought into contact with one of the second fixed contacts 14 and 15 and, at the same time, the second contacting piece 22 on the second region Z2 side, as well as the first contacting piece 21 on the first region Z1 side, are brought into contact with the common fixed contact 11. Thus, switching movement of the movable contacting piece 2 with respect to the common fixed contact 11 is effected on the second region Z2 side, where the interval W2 is wider. Therefore, even if carbonized substances or the like are produced by arc discharge generated at a moment where the movable contacting piece 2 is brought into contact with the common fixed contact 11, the insulating property between the common fixed contact 11 and the first and second fixed contacts 12 to 15 remains substantially unchanged.

The operation of the two-step operation switch device S described above will now be described by reference to FIGS. 1 to 4 of the drawings.

FIG. 1 shows a state where the knob 65 is not operated and the movable contacting piece 2 is at the neutral position N. In this state, since the movable contacting piece 2 is contacted with none of the fixed contacts 11 to 15, the two-step operation switch device S inputs no operation signal to a controller circuit formed on the base plate 7.

FIG. 2 shows a state where the knob 65 is set at a manual down position, and the movable contacting piece 2 is moved from the neutral position N to one of the first positions MD. In this state, the movable contacting piece 2 is contacted both with the common fixed contact 11 and with one of the first fixed contacts 12 to bridge the two fixed contacts 11 and 12. In this way, the two-step operation switch device S inputs a manual down operation signal to the controller circuit formed on the base plate 7. When the manual down operation signal is inputted from the two-step operation switch device to the controller, the latter controls the actuator of a window regulator, which carries out opening action of a window glass only during a period of time when the manual down operation signal is inputted.

FIG. 3 shows a state where the knob 65 is set at the automatic down position, and the movable contacting piece 2 is moved from the neutral position N to one of the second positions AD. In this state, the movable contacting piece 2 is contacted both with the common fixed contact 11 and with one of the first fixed contacts 14 to bridge the two fixed contacts 11 and 14. In this way, the two-step operation switch device inputs an automatic down operation signal to the controller formed on the base plate 7. When the automatic down operation signal is inputted from the two-step operation switch device S to the controller, the latter controls the actuator of the window regulator, which carries out automatic opening action of the window glass until the window glass is completely opened by continuing to move the window glass even after input of the automatic down operation signal is stopped.

However, if the knob 65 is moved to a manual up position during the automatic opening action, the movable contacting piece 2 is brought into contact with one of the first fixed contacts 13. In this way, the automatic opening action is cancelled so that the window glass is stopped. On the contrary, if the knob 65 is moved to an automatic up position during the automatic opening action, the movable contacting piece 2 is brought into contact with one of the second fixed contacts 15 and, in this way, the window glass is moved in the reverse direction to the closing side.

Operation in the case where the knob 65 is set at the manual up position or the automatic up position is similar to that described above and, therefore, will not be described in detail. However, if the knob 65 is moved to the manual down position during the automatic closing operation of the window glass, the movable contacting piece 2 is brought into contact with one of the first fixed contacts 12 and, in this way, the automatic closing operation is cancelled to stop the window glass. On the other hand, if the knob 65 is moved to the automatic down position during the automatic closing operation, the movable contacting piece 2 is brought into contact with one of the second fixed contacts 14 and, in this way, the window glass is moved in the reverse direction to the opening side. Further, in the case where the actuator is in a locked state due to the fact that a window glass moving mechanism is obstructed by foreign matter during the automatic closing operation, it is cancelled and the window glass is moved in the reverse direction to the opening side.

Since the present invention has the construction and the action described above, the intervals between the common fixed contact and the first and second fixed contacts can be made wider and, therefore, it is possible to keep the insulating property between the common fixed contact and the first and second fixed contacts in a normal state. In particular, since switching action effected between the movable contacting piece and the common fixed contact is carried out on the second region side where the interval is wider, an effect can be obtained that, even if carbonized substances and the like produced by arc discharge generated at a moment where the movable contacting piece is brought into contact with the common fixed contact, the insulating property between the common fixed contact and the first and second fixed contacts remains substantially unchanged.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A two-step operation switch device comprising:

an insulating plate (1);

a movable contacting piece (2) movable between a neutral position (N), first positions (MU, MD), and second positions (AU, AD) with respect to said insulating plate (1); and a common fixed contact (11), two first fixed contacts (12, 13) and two second fixed contacts (14, 15) disposed on said insulating plate (1), said common fixed contact disposed between said first fixed contacts and said second fixed contacts;

said movable contacting piece (2) including a first contacting piece (21) sliding in a first region (Z1), in which said common fixed contact (11) and said first fixed contacts (12, 13) are juxtaposed, and a second contacting piece (22) sliding in a second region (Z2), in which said common fixed contact (11) and said second fixed contacts (14, 15) are juxtaposed;

an interval (W2) between said common fixed contact (11) and said second fixed contacts (14, 15) in said second region (Z2) is set so as to be greater than an interval (W1) between said common fixed contact (11) and said first fixed contacts (12, 13) in said first region (Z1); and at least one of said common fixed contact (11) and said movable contacting piece (2) is so shaped that said movable contacting piece (2) is connected both with said first fixed contacts (12, 13) in said first region (Z1) and with said common fixed contact (11) in said second region (Z2) when said movable contacting piece (2) is at said first positions (MU, MD).

2. The two-step operation switch according to claim 1, wherein said second region is discrete and non-overlapping with respect to said first region.

3. The two-step operation switch device according to claim 2, wherein a width (W4) of said common fixed contact (11) within said second region (Z2) is greater than a width (W3) of said common fixed contact region within said first region.

4. The two-step operation switch device according to claim 3, wherein said neutral position corresponds to a neutral position of a power window, said first positions (MU, MD) correspond to manual operation positions of the power window, and said second positions (AU, AD) correspond to automatic operation positions of the power window.

5. The two-step operation switch device according to claim 1, wherein said neutral position corresponds to a neutral position of a power window, said first positions (MU, MD) correspond to manual operation positions of the power window, and said second positions (AU, AD) correspond to automatic operation positions of the power window.

6. The two-step operation switch according to claim 1, wherein said common fixed contact is flat and includes two pairs of contacting pieces, each of said contacting pieces extending a common distance from a central portion.

7. The two-step operation switch according to claim 6, wherein said central portion is in continuous contact with said common fixed contact.

* * * * *